US011814873B2

(12) United States Patent
Clifford

(10) Patent No.: US 11,814,873 B2
(45) Date of Patent: Nov. 14, 2023

(54) CYLINDRICAL LOCK STATUS INDICATOR

(71) Applicant: dormakaba USA Inc., Indianapolis, IN (US)

(72) Inventor: Jason C. Clifford, Noblesville, IN (US)

(73) Assignee: dormakaba USA Inc., Indianapolis, IN (US)

( * ) Notice: Subject to any disclaimer, the term of this patent is extended or adjusted under 35 U.S.C. 154(b) by 336 days.

(21) Appl. No.: 17/174,647

(22) Filed: Feb. 12, 2021

(65) Prior Publication Data

US 2021/0372161 A1 Dec. 2, 2021

Related U.S. Application Data

(60) Provisional application No. 63/033,034, filed on Jun. 1, 2020.

(51) Int. Cl.
*E05B 41/00* (2006.01)
*E05B 47/00* (2006.01)

(52) U.S. Cl.
CPC ..... *E05B 41/00* (2013.01); *E05B 47/0038* (2013.01)

(58) Field of Classification Search
CPC ..... E05B 13/10; E05B 13/106; E05B 13/108; E05B 17/10; E05B 39/00; E05B 41/00; E05B 47/0038
See application file for complete search history.

(56) References Cited

U.S. PATENT DOCUMENTS

| | | | | |
|---|---|---|---|---|
| 9,879,445 | B2 * | 1/2018 | Gopalakrishnan | E05B 63/06 |
| 10,301,843 | B2 * | 5/2019 | Basavaraju | E05B 27/0092 |
| 10,563,425 | B2 * | 2/2020 | Lunday | E05B 17/10 |
| 11,236,526 | B2 * | 2/2022 | Shetty | E05B 1/0038 |
| 11,359,408 | B2 * | 6/2022 | Kim | E05B 41/00 |
| 11,377,872 | B2 * | 7/2022 | Barker | E05B 13/101 |
| 11,408,206 | B2 * | 8/2022 | Lunday | E05B 13/101 |
| 2018/0230711 | A1 | 8/2018 | Gopalakrishnan et al. | |
| 2019/0323264 | A1 | 10/2019 | Lunday | |
| 2021/0230903 | A1 * | 7/2021 | Fournier | E05B 41/00 |

FOREIGN PATENT DOCUMENTS

| | | | |
|---|---|---|---|
| CN | 1180780 | A | 5/1998 |
| DE | 202004009405 | U1 | 8/2004 |
| JP | 64-017978 | A | 1/1989 |
| JP | 2008-261138 | A | 10/2008 |

* cited by examiner

*Primary Examiner* — Kristina R Fulton
*Assistant Examiner* — Noah Horowitz
(74) *Attorney, Agent, or Firm* — Faegre Drinker Biddle & Reath LLP

(57) ABSTRACT

Lock indicators useable to signal the locked or unlocked state of one side of a cylindrical lock across the door selectively secured by the lock. For example, the present disclosure provides a cylindrical lock having an entry function with an indicator viewable by occupants of an area secured by the cylindrical lock. The lock indicators are magnetically driven.

16 Claims, 12 Drawing Sheets

Fig. 7A
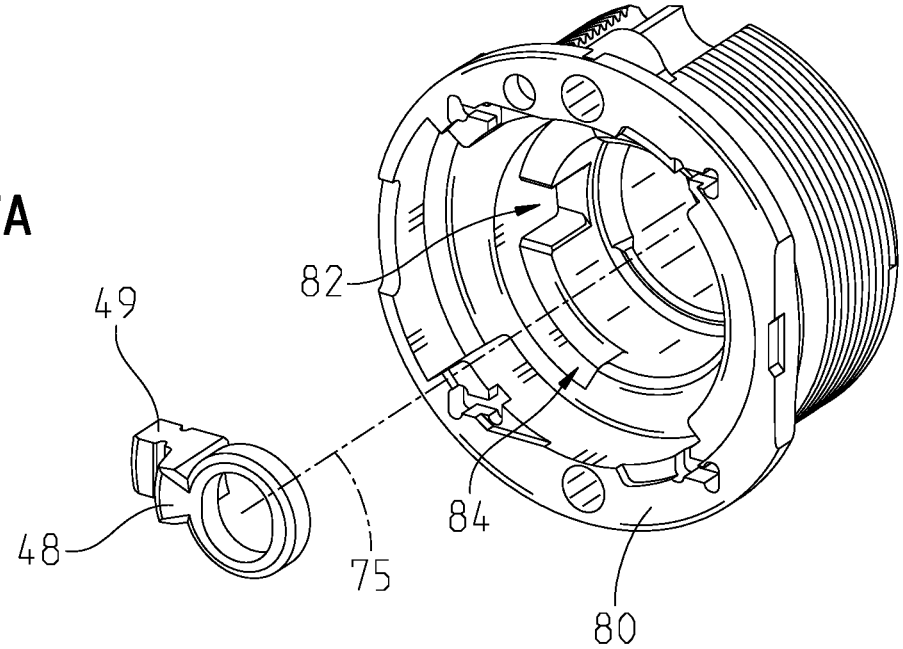
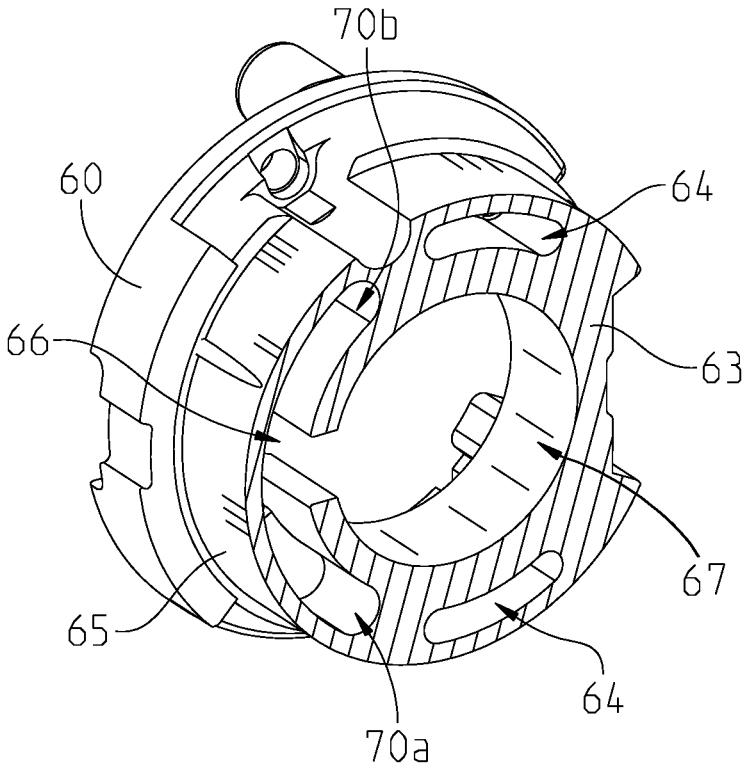
Fig. 7B

CYLINDRICAL LOCK STATUS INDICATOR

CROSS REFERENCE TO RELATED APPLICATION

This application claims priority to U.S. Provisional Patent Application No. 63/033,034 filed Jun. 1, 2020, entitle CYLINDRICAL LOCK STATUS INDICATOR, the entire disclosure of which is expressly incorporated by reference herein.

FIELD

The present disclosure relates to door locks and, in particular, to door locks having a lock status indicator.

BACKGROUND

Door locks can take a number of different forms, including cylindrical locks and mortise locks. In certain instances, the door may be placed in a locked state to limit ingress and egress by a lock function. It may be advantageous to signal to occupants or those outside of a space secured by a door that the door lock maintains the locked condition, limiting ingress and/or egress. However, cylindrical locks present unique challenges for transmitting a lock status between ingress and egress sides of a door.

SUMMARY

The present disclosure provides lock indicators useable to signal the locked or unlocked state of a lock at one or both sides of a door selectively secured by the lock. Throughout this document, "inside" will be used to reference the side of a door and lock actuator available to occupants of an area secured by the lock, while "outside" will be used to reference the side of a door and lock actuator available to those seeking ingress to the secured area.

In an exemplary embodiment of the present disclosure, a cylindrical lock having a first side and a second side is provided, the lock including a latch bolt moveable between an engaged position operable to limit ingress and egress and a disengaged position operable to permit ingress and egress; a first actuator operable to receive a first operator input motion to actuate the first actuator to move the latch bolt from the engaged position to the disengaged position, the first actuator being on the first side of the cylindrical lock; a second actuator operable to receive a second operator input motion to actuate the second actuator to move the latch bolt from the engaged position to the disengaged position, the second actuator being positioned on the second side of the cylindrical lock; a first locking lug actuatable between a locked position and an unlocked position, the locked position of the first locking lug corresponding to the cylindrical lock in a locked condition blocking the first operator input motion from actuating the first actuator to move the latch bolt from the engaged position to the disengaged position; a magnet holder having at least one permanent magnet, the magnet holder selectively operably coupled to the first locking lug such that the magnet holder moves with the first locking lug between the locked position and the unlocked position when the magnet holder and the first locking lug are operably coupled; and a flag having a lock signal signaling the locked position of the first locking lug and an unlock signal signaling the unlocked position of the first locking lug, the flag selectively displaying only one of the lock signal and the unlock signal, the flag being magnetically-driven by the at least one permanent magnet of the magnet holder between a lock signal position displaying the lock signal and an unlock signal position displaying the unlock signal.

In an example thereof, the locking lug undergoes a movement with the first actuator input motion when the locking lug is in the unlocked position, the movement of the locking lug decoupling the locking lug and the magnet holder.

In an example thereof, the cylindrical lock further comprises a first hub on the first side of the cylindrical lock and a second hub on the second side of the cylindrical lock, wherein in the locked position of the first locking lug, the first hub blocks a movement of the first locking lug and thereby blocks the first operator input motion from actuating the first actuator to move the latch bolt from the engaged position to the disengaged position; and a second locking lug operably coupled to the first locking lug and operable to transition between a first position associated with the engaged position of the first locking lug and a second position associated with the disengaged position.

In a further example thereof, the at least one permanent magnet of the magnet holder includes a coupling permanent magnet operable to selectively couple with the second locking lug, and thereby with the first locking lug, and transition with the second locking lug between the first position and the second position.

In a further example thereof, the cylindrical lock further comprises a cuff positioned coaxially with the second hub, the cuff operable to transition between a locked status position and an unlocked status position.

In a further example thereof, the cuff includes a first extension portion and a second extension portion, the first extension portion and the second extension portion including a plurality of permanent magnets forming a first magnetic field and a second magnetic field, wherein when the magnet holder is in the first position the magnet holder interacts with the first magnetic field driving the cuff to the locked status position and when the magnet holder is in the second position the magnet holder interacts with the second magnetic field resulting in driving the cuff to the unlocked status position.

In a further example thereof, the indicator is operably coupled to the cuff and operable to move with the cuff between the locked status position and the unlocked status position.

In yet another example thereof, the cylindrical lock further comprises a cuff positioned coaxially with the second hub, the cuff operable to transition between a locked status position and an unlocked status position.

In an example thereof, the cuff includes a first extension portion and a second extension portion, the first extension portion and the second extension portion including a plurality of permanent magnets forming a first magnetic field and a second magnetic field, wherein when the magnet holder is in the first position the magnet holder interacts with the first magnetic field driving the cuff to the locked status position and when the magnet holder is in the second position the magnet holder interacts with the second magnetic field resulting in driving the cuff to the unlocked status position.

In an example thereof, the flag is operably coupled to the cuff and operable to move with the cuff between the locked status position corresponding to the lock signal position of the flag, and the unlocked status position corresponding to the unlock signal position of the flag.

In an exemplary embodiment of the present disclosure, a lock indicator assembly for a cylindrical lock having a first side and a second side, the lock indicator assembly comprising: a first locking lug positioned on the first side of the cylindrical lock and actuatable between a locked position and an unlocked position, the locked position of the locking lug positioning the cylindrical lock in a locked condition; a shaft extending from the first side of the cylindrical lock to the second side of the cylindrical lock and actuatable between a first shaft position associated with the locked position of the locking lug and a second shaft position associated with the unlocked position of the locking lug; a second locking lug positioned on the second side of the cylindrical lock and operably coupled to the first locking lug via the shaft and actuatable between a corresponding locked position associated with the locked position of the first locking lug and a corresponding unlocked position associated with the unlocked position of the first locking lug; a cuff positioned on the second side of the cylindrical lock, the cuff actuatable between a locked status position associated with the locked position of the first locking lug, the first shaft position, and the corresponding locked position of the second locking lug, and an unlocked status position associated with the unlocked position of the first locking lug, the second shaft position, and the corresponding unlocked position of the second locking lug; and a flag operably coupled to the cuff such that the flag moves with the cuff, the flag operable to display a locked status when the cuff is in the locked status position and an unlocked status when the cuff is in the unlocked status position.

In an example thereof, the cylindrical lock further comprises a magnet holder with at least one permanent magnet positioned on the second side of the cylindrical lock and operably and selectively coupled with the second locking lug and operable to transition between a first position associated with the locked position of the first locking lug and a second position associated with the unlocked position of the first locking lug, the magnet holder with at least one permanent magnet operable to drive the cuff.

In another example thereof, the lock indicator assembly for a cylindrical lock further includes: a first hub positioned on the first side of the cylindrical lock, the first hub having a lock channel, said first locking lug occupying said lock channel in the locked position, the lock channel blocking a movement of the first locking lug needed to actuate the cylindrical lock; and a second hub positioned on the second side of the cylindrical lock, the second locking lug having an interior space, the second locking lug moving between the corresponding locked position and the corresponding unlocked position within the interior space of the second hub.

In yet another example thereof, the lock indicator assembly further comprises a magnet holder with at least one magnet holder permanent magnet, the magnet holder positioned on the second side of the cylindrical lock and operably and selectively coupled with the second locking lug and operable to transition between a first magnet holder position associated with the locked position of the first locking lug and a second magnet holder position associated with the unlocked position of the first locking lug, the at least one magnet holder permanent magnet operable to magnetically drive the cuff between the locked status position and the unlocked status position.

In a further example thereof, the cuff includes a first extension portion and a second extension portion, the first extension portion and the second extension portion including a plurality of cuff permanent magnets forming a first magnetic field and a second magnetic field, the magnet holder magnetically engaging the first magnetic field of the cuff in the first magnet holder position to position the cuff in the locked status position, the magnet holder magnetically engaging the second magnetic field of the cuff in the second magnet holder position to position the cuff in the unlocked status position.

In a further example thereof, the first extension portion of the cuff is circumferentially spaced from the second extension portion of the cuff.

In a further example thereof, the cuff and the flag are operable to rotate between the locked status position and the unlocked status position.

In a further example thereof, the flag includes a lock status indicator and an unlocked status indicator.

In a further example thereof, the plurality of cuff permanent magnets includes a first cuff permanent magnet positioned with the first extension portion at a first longitudinal position relative to the cuff and a second cuff permanent magnet positioned with the second extension portion at the first longitudinal position relative to the cuff, the first and second cuff permanent magnets forming the first magnetic field, and wherein the plurality of permanent magnets includes a third cuff permanent magnet positioned with the first extension portion at a second longitudinal position relative to the cuff and a fourth cuff permanent magnet positioned with the second extension portion at the second longitudinal position relative to the cuff, the third and fourth permanent magnets forming the second magnetic field.

In a further example thereof, the first and second cuff permanent magnets are oriented such that north poles are substantially facing toward each other, and wherein the third and fourth cuff permanent magnets are oriented such that south poles are substantially facing toward each other.

In a further example thereof, the at least one magnet holder permanent magnet comprises at least two magnet holder permanent magnets operable to selectively magnetically interact with the first and second magnetic fields formed by the plurality of cuff permanent magnets, the at least two magnet holder permanent magnets each having opposite poles oriented in substantially the same direction.

In an exemplary embodiment of the present disclosure, an access device operable to selectively block and permit access through a barrier, comprising: an actuator operable to receive an operator input motion to rotate the actuator to allow access through the barrier, the actuator extending from a first side of the barrier; a lock actuatable between a locked position and an unlocked position, the locked position of the lock positioning the lock in a locked condition blocking the operator input motion from rotating the actuator to allow access through the barrier, the lock comprising: a first hub having a lock channel; a first locking lug, the first locking lug occupying the lock channel of the first hub in the locked position of the lock and thereby blocking the operator input motion from rotating the actuator to allow access through the barrier, the first locking lug rotating with the actuator with the operator input motion in the unlocked position of the lock; and an indicator having a lock signal signaling the locked position of the lock and an unlock signal signaling the unlocked position of the lock, the indicator selectively displaying only one of the lock signal and the unlock signal, the indicator having a lock signal display position in which the lock signal is displayed and an unlock signal display position in which the unlock signal is displayed; the first locking lug selectively magnetically coupled to the indicator so that a transition of the lock from the unlocked position to the locked position positions the indicator in the lock signal display position and a transition of the lock from the locked position to the unlocked position positions the indicator in the unlock signal display position, in the unlocked position of the lock the first locking lug decoupled from the indicator, with the indicator maintaining the unlock signal display position throughout the operator input motion to rotate the actuator and the lug.

In an example thereof, the access device further comprises: a magnet holder, the magnet holder selectively magnetically coupling the first locking lug to the indicator, the magnet holder operable to magnetically actuate the indicator between the lock signal display position and the unlock signal display position.

In an example thereof, the indicator comprises a flag, the access device further comprising: a cuff coupling the magnet holder and the flag.

In an example thereof, the lock further comprises: a second hub, the first hub positioned through a first side of the barrier, the second hub positioned through a second side of the barrier; a shaft extending between the first hub and the second hub; and a second locking lug, the shaft coupling the first locking lug and the second locking lug, the second hub having an interior space, the second locking lug moving within the interior space of the second hub when the first locking lug moves, the shaft and the second locking lug selectively magnetically coupling the first locking lug to the indicator.

In an exemplary embodiment, lock indicator mechanism for a lock on a door comprising: a first lug having an engagement portion transitionable between a locked position and an unlocked position, the engagement portion limiting movement of the first lug when in the locked position; a second lug that is transitionable between a corresponding locked position and a corresponding unlocked position; a shaft extending between the first lug and the second lug such that linear movement of one of the first or second lock inputs results in linear movement of both the first and second lock inputs; a cuff rotatably positioned with the second lock input, the cuff including a plurality of cuff magnets defining a first magnetic field and a second magnetic field; a magnet holder including at least one magnet holder magnet, the magnet holder operably coupled to the second lug such that when the second lug is positioned in the corresponding locked position, the at least one magnet holder magnet interacts with the first magnetic field causing the cuff to rotate to a first cuff position, and such that when the second lug is positioned in the corresponding unlocked position, the at least one magnet holder magnet interacts with the second magnetic field causing the cuff to rotate to a second cuff position; and a lock indicator operably coupled with the cuff such that the lock indicator rotates with the cuff and is operable to display a locked status and an unlocked status.

In an example thereof, the magnet holder includes a first permanent magnet operable to removably couple to the second lug and a second magnet operable to interact with the first and second magnetic fields.

In an example thereof, the lock indicator mechanism further includes a hub forming a magnet holder channel extending longitudinally and within which the magnet holder is operable to longitudinally transition.

In an example thereof, the hub forms cuff channels extending at circumferentially and within which portions of the cuff are operable to circumferentially transition as the cuff rotates.

BRIEF DESCRIPTION OF THE DRAWINGS

The above-mentioned and other features and advantages of this disclosure, and the manner of attaining them, will become more apparent and will be better understood by reference to the following description of exemplary embodiments taken in conjunction with the accompanying drawings, wherein:

FIG. 7A is an exploded view of a hub and locking lug, the hub including a lock channel and an unlock channel within which an engagement portion of the locking lug can be positioned in order to limit ingress and/or egress, according to one embodiment;

FIG. 7B is a sectional view of a hub including a magnet holder channel, cuff channels, and magnet holder channels, according to one embodiment;

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

Figure 1:
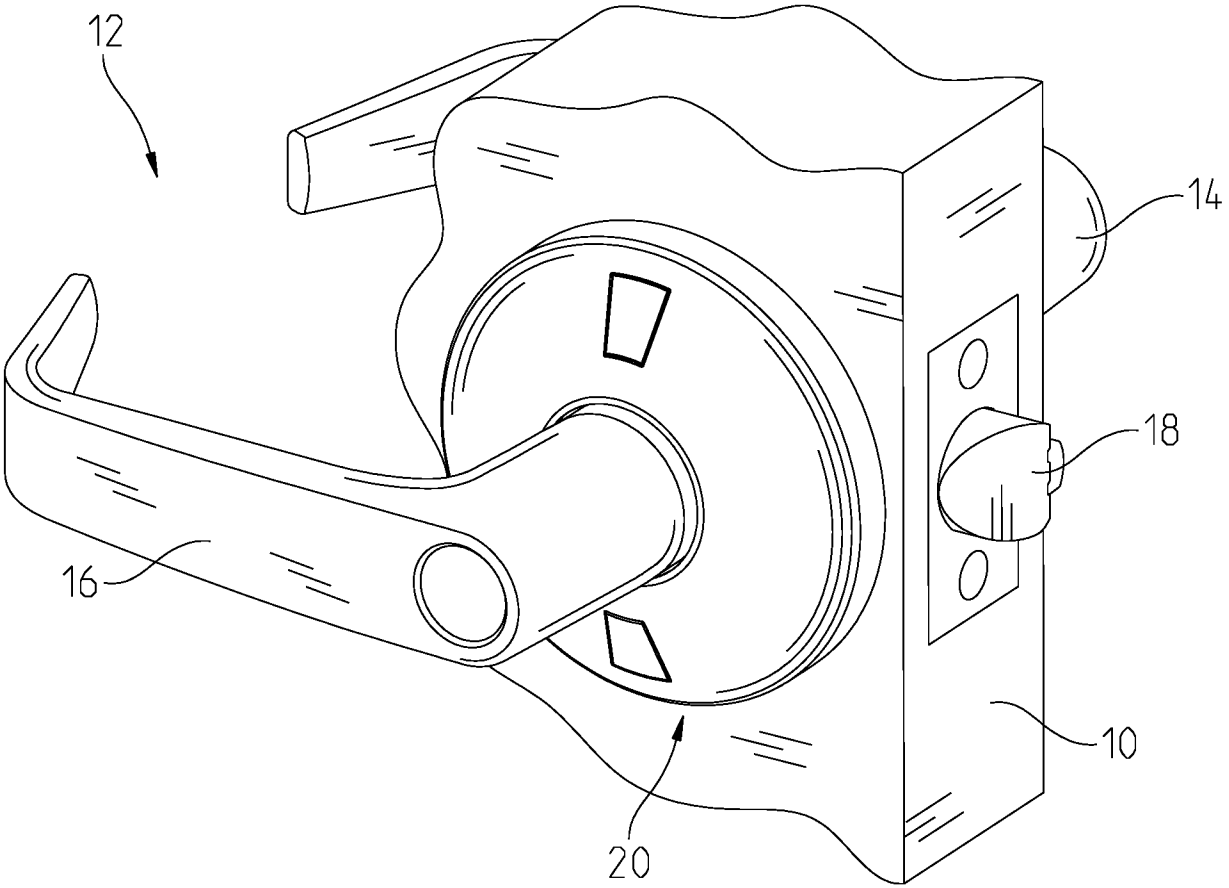
FIG. 1 is a perspective view of door lock mounted on a door, the door lock including a lock indicator system, according to one embodiment.

For the purposes of promoting an understanding of the principles of the present disclosure, reference is now made to the embodiments illustrated in the drawings, which are described below. The embodiments disclosed herein are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The terms "couples", "coupled", "coupler" and variations thereof may be used to include both arrangements wherein the two or more components are in direct physical contact and arrangements wherein the two or more components are not in direct contact with each other (e.g., the components are "coupled" via at least a third component), but yet still cooperate or interact with each other.

In some instances throughout this disclosure and in the claims, numeric terminology, such as first, second, third, and fourth, may be used in reference to various components or features. Such use is not intended to denote an ordering of the components or features. Rather, numeric terminology is used to assist the reader in identifying the component or features being referenced and should not be narrowly interpreted as providing a specific order of components or features.

FIG. 1 illustrates a barrier exemplified as door 10 having door lock 12. As illustrated, door lock 12 is exemplified as a cylindrical lock. Cylindrical locks are well known in the art; therefore, in the description that follows only certain details of the exemplary locks are described in detail, with the detailed description instead focusing on the indicator apparatus and associated method of use.

As illustrated in FIG. 1, door lock 12 includes an egress actuator exemplified as egress handle 14. Door lock 12 further includes an ingress actuator exemplified as ingress handle 16. Door lock 12 is operably coupled to door 10. Door 10 is, in use, arranged to selectively allow and disallow ingress and egress from an area selectively covered by door 10. In an exemplification, door 10 can be hinged to a doorframe and can be selectively secured thereto by latch bolt 18, as is well known in the art. In an unlocked state of door lock 12, both egress handle 14 and ingress handle 16 can be actuated by an operator input motion to move latch bolt 18 from the extended position illustrated in FIG. 1 to a retracted position allowing ingress and egress through the door 10. When one of egress handle 14 and ingress handle 16 is actuated to move latch bolt 18 to the retracted position, door 10 can be moved relative to its doorframe to allow ingress and egress therethrough. Translation of rotational movement of egress handle 14 and ingress handle 16 to retraction of latch bolt 18 is well known in the art and is therefore not described for the sake of brevity. In its simplest form such a mechanism can take the form of a cam rotated by ingress handle 16 or egress handle 14 to reciprocate latch bolt 38 between its extended and retracted positions.

Figure 2:
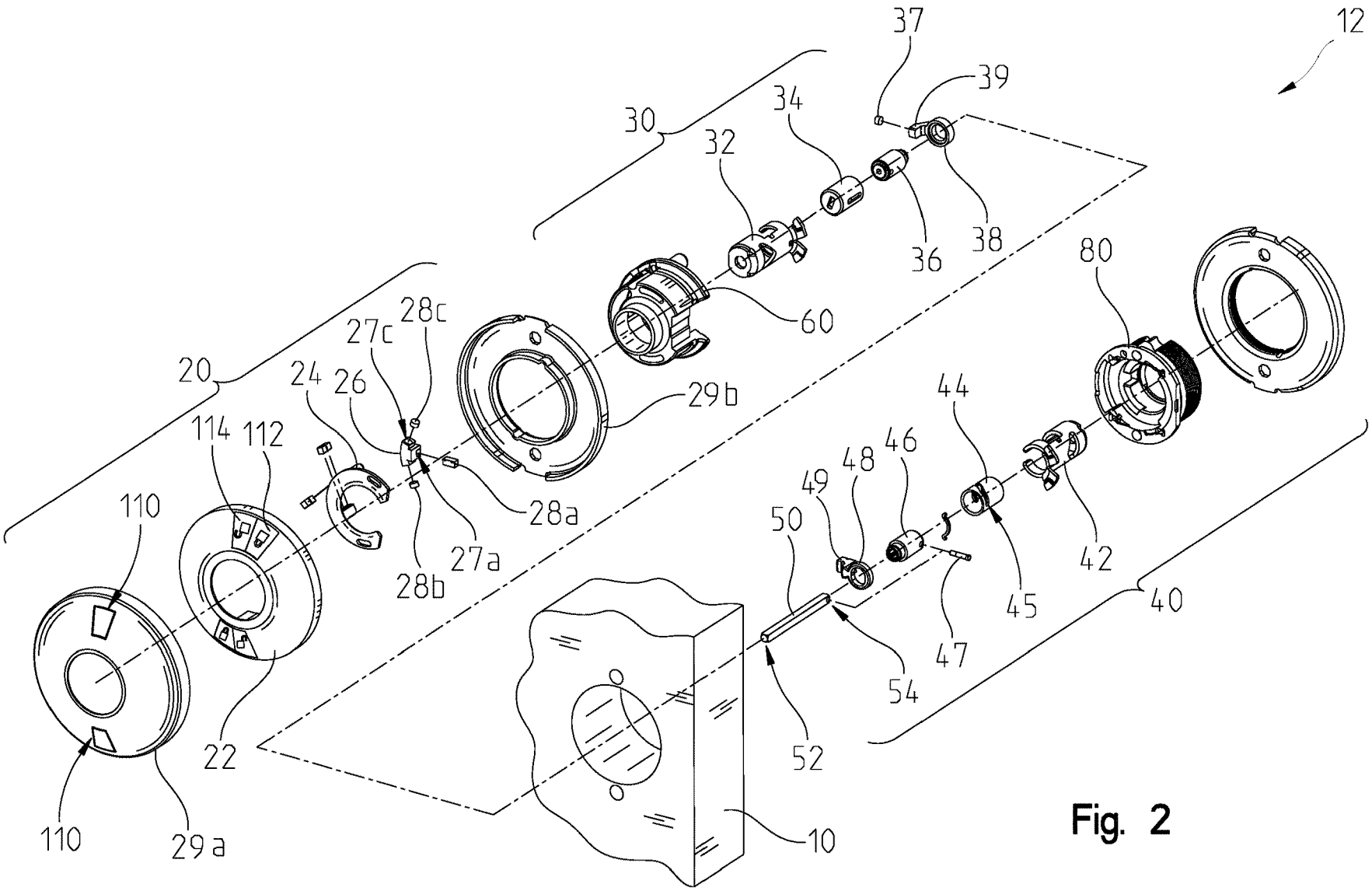
FIG. 2 is an exploded view of lock assemblies on each side of a door and a lock indicator assembly, according to one embodiment.

Referring to FIG. 2, door lock 12 further includes lock indicator assembly 20, interior lock assembly 30, and exterior lock assembly 40. Lock indicator assembly 20 is operable to display to a user the lock status of door lock 12 (e.g., a locked status or an unlocked status). More specifically, lock indicator assembly 20 displays to a user a lock status of either interior lock assembly 30 or exterior lock assembly 40. Lock indicator assembly 20 may be placed on either side of door 10, and in some embodiments, on both sides of door 10. In some embodiments, lock indicator assembly 20 displays the lock status of one of interior or exterior lock assemblies 30, 40 when lock indicator assembly 20 is positioned on the opposite side of door 10 relative to interior or exterior lock assembly 30 or 40. Stated otherwise, the lock status of the respective interior or exterior lock assembly 30 or 40 is transmitted for display by lock indicator assembly 20 across door 10 from an interior side to an exterior side or from an exterior side to an interior side. Furthermore, the lock status of interior or exterior lock assembly 30 or 40 is transmitted mechanically across door 10.

Lock indicator assembly 20 transitions between displaying a locked status and an unlocked status corresponding to the locked or unlocked state of door lock 12 established by either an interior lock input or an exterior lock input of door lock 12 (for example, interior or exterior lock inputs may include keyed lock inputs, thumb-turn inputs, and push button inputs). As seen in FIG. 2, lock indicator assembly 20 includes flag 22, cuff 24, magnet holder 26, and rose 29*a* with rose liner 29*b*, as will be discussed hereafter. Lock indicator assembly 20 is magnetically driven such that when lock status of a door lock 12 is transitioned between a locked status and an unlocked status, lock indicator assembly 20 is actuated via magnetic fields to transition between a first position and a second position. Because operation of a locking assembly from the lock input to the locking lug (e.g., locking lug 48 described further below) is well known to persons having ordinary skill in the art, it is not described here for the sake of brevity. Additional description of various cylindrical locks, including entrance, privacy, and intruder locks can be found in U.S. Provisional Patent Application Ser. No. 63/005,886 filed Apr. 6, 2020 and the U.S. utility application assigned, entitled CYLINDRICAL LOCK STATUS INDICATOR and filed on even date herewith, the entire disclosures of which are hereby incorporated by reference in their entireties. In its simplest form, the log input can simply transfer a longitudinal user motion to longitudinal displacement of the locking lug. Various cam mechanisms may be utilized to transmit a rotary user input to longitudinal displacement of the locking lug.

An overview of components of interior and exterior lock assemblies 30, 40 is provided to facilitate an understanding of how lock indicator assembly 20 functions with respect to interior and/or exterior lock assemblies 30, 40. A description of the lock indicator assembly 20 will follow. Finally, a description of the interaction between lock indicator assembly 20 and interior and exterior lock assemblies 30, 40 will be provided. Although the following discussion may at times designate interior lock assembly 30 as having certain components or features and exterior lock assembly 40 as having certain components or features, in some embodiments those components or features may be exchanged. For example, those components and features associated with interior lock assembly 30 as discussed may be implemented on exterior lock assembly 40 and those components or features associated with exterior lock assembly 40 as discussed may be implemented on interior lock assembly 30. Stated otherwise, door lock 12 may be implemented to prevent ingress while allowing egress, or alternatively prevent egress while allowing ingress. For example, the below disclosure discusses a classroom or "intruder" function door lock, whereas the components may be reversed to provide the opposite function for the door lock (e.g., used in interrogation rooms).

Figure 3:
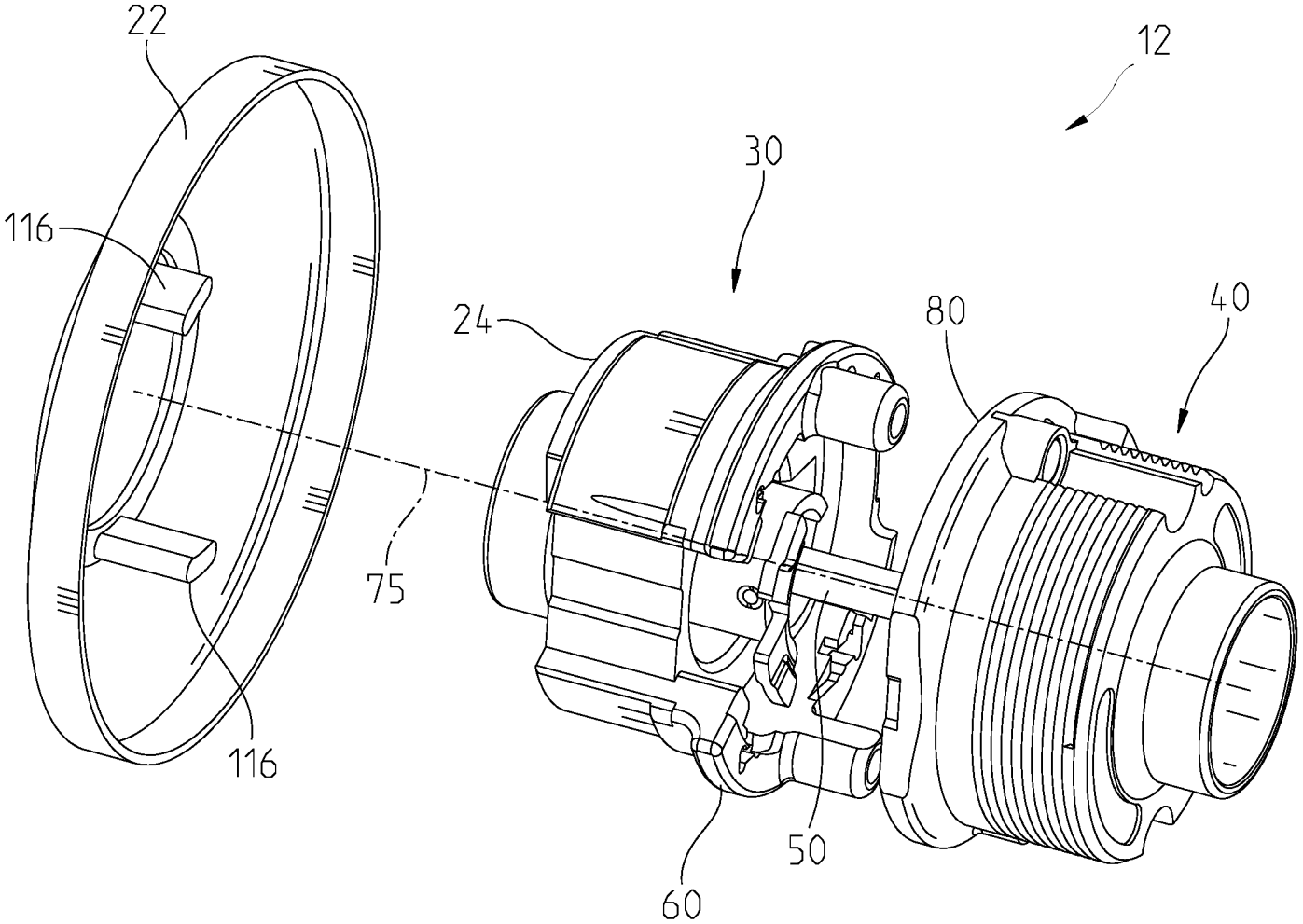
FIG. 3 is a perspective view of an interior lock assembly positioned with an exterior lock assembly and a flag for displaying lock and unlock statuses, according to one embodiment.
Figure 4:
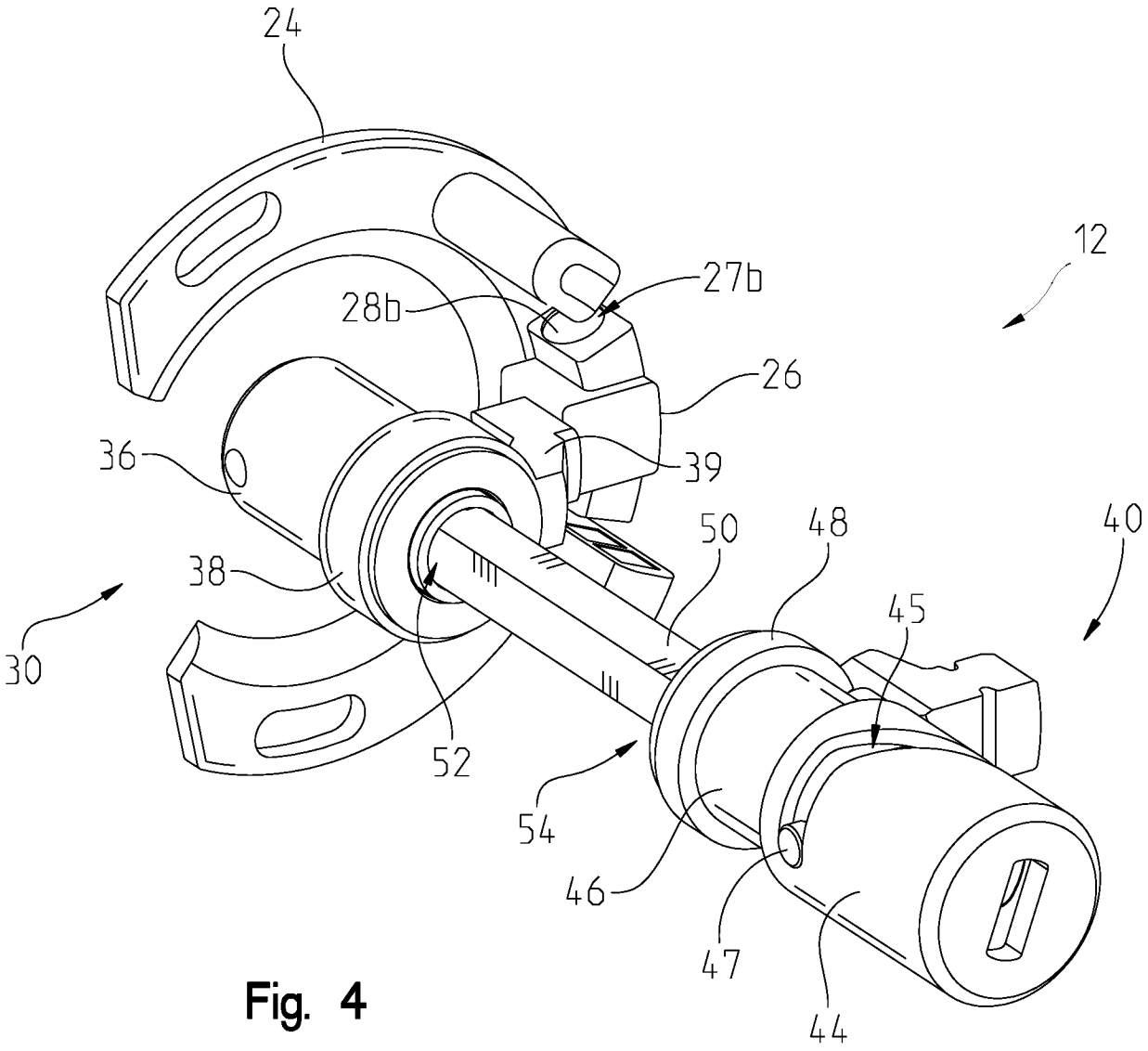
FIG. 4 is a perspective view of locking lugs coupled to a shaft for transmitting a lock status, where one of the lugs is magnetically coupled to a magnet holder, the magnet holder operable to drive a cuff of the lock indicator assembly, according to one embodiment.

Referring now to FIGS. 2-4, door lock 12 includes interior lock assembly 30 and exterior lock assembly 40. Interior lock assembly 30 corresponds with an interior side of door 10 and egress handle 14 and exterior lock assembly 40 corresponds with an exterior side of door 10 and ingress handle 16. Interior and exterior lock assemblies 30, 40 transition between a locked position and an unlocked position. In some embodiments, interior and exterior lock assemblies 30, 40 are transitioned between the locked and unlocked conditions (e.g., via a key that is operable to actuate exterior lock assembly 40 and/or interior lock assembly 30). Interior and exterior lock assemblies 30, 40 are operably coupled or harnessed such that interior and exterior lock assemblies 30, 40 are transitioned between states together. For example, when exterior lock assembly 40 is transitioned from a locked state (e.g., operator input motion is blocked from actuating latch bolt 18) to an unlocked state (e.g., operator input motion results in actuation of latch bolt 18), the interior lock assembly 30 is transitioned from a first state to a second state corresponding to the locked state and the unlocked state of the exterior lock, respectively. Furthermore, this allows exterior lock assembly 40 to be transitioned between the locked and unlocked state from either the exterior side of door 10 or interior side of door 10.

Referring to FIG. 2, interior lock assembly 30 includes interior release cam 32, interior cam sleeve 34, interior lug carrier 36, interior lug 38, and interior hub 60. Interior release cam 32 is operable to rotate in response to operator input motion to reciprocate an output for actuation of latch bolt 18. Interior lug carrier 36 and interior lug 38 are rotationally constrained relative to interior release cam 32. Interior lug carrier 36 is positioned within interior cam sleeve 34. Interior lug 38 is coupled to interior lug carrier 36 such that when interior lug carrier 36 is transitioned between various positions, interior lug 38 transitions with interior lug carrier 36. Interior lug 38 is positioned within interior hub 60 and moves relative to interior hub 60 (e.g., translates linearly within interior hub 60 and rotates within interior hub 60). Interior lock assembly 30 further includes lock indicator engagement portion 39. Lock indicator engagement portion 39 extends from or is incorporated into interior lug 38. In some embodiments, lock indicator engagement portion 39 is formed of a ferromagnetic material, such that a magnet is releasably couplable to lock indicator engagement portion 39 of interior lug 38. In some embodiments, lock indicator engagement portion 39 includes lug magnet 37 (e.g., a permanent magnet) coupled to, embedded in, or otherwise extending from interior lug 38. Lock indicator engagement portion 39 is operable to engage components of lock indicator assembly 20, as will be discussed.

Referring still to FIG. 2, exterior lock assembly 40 includes exterior release cam 42, exterior cam sleeve 44, exterior lug carrier 46, exterior lug 48, and exterior hub 80. Exterior release cam 42 is operable to rotate in response to operator input motion to reciprocate an output for actuation of latch bolt 18. Exterior lug carrier 46 and exterior lug 48 are rotationally constrained relative to exterior release cam 42. Exterior lug carrier 46 is positioned within exterior cam sleeve 44. Exterior lug 48 is coupled to exterior lug carrier 46 such that when exterior lug carrier 46 is transitioned between various positions, exterior lug 48 transitions with exterior lug carrier 46. Exterior lug 48 is positioned within and moves relative to exterior hub 80 (e.g., translates linearly within exterior hub 80 and rotates within exterior hub 80). Exterior lug 48 is positioned with exterior hub 80 such that features of exterior lug 48 interact with features of exterior hub 80 to provide the lock and unlock condition of door lock 12. For example, exterior lug 48 includes engagement portion 49 that interacts with features of exterior hub 80 that selectively permit or restrict rotation of exterior lug 48 relative to exterior hub 80.

Figure 5:
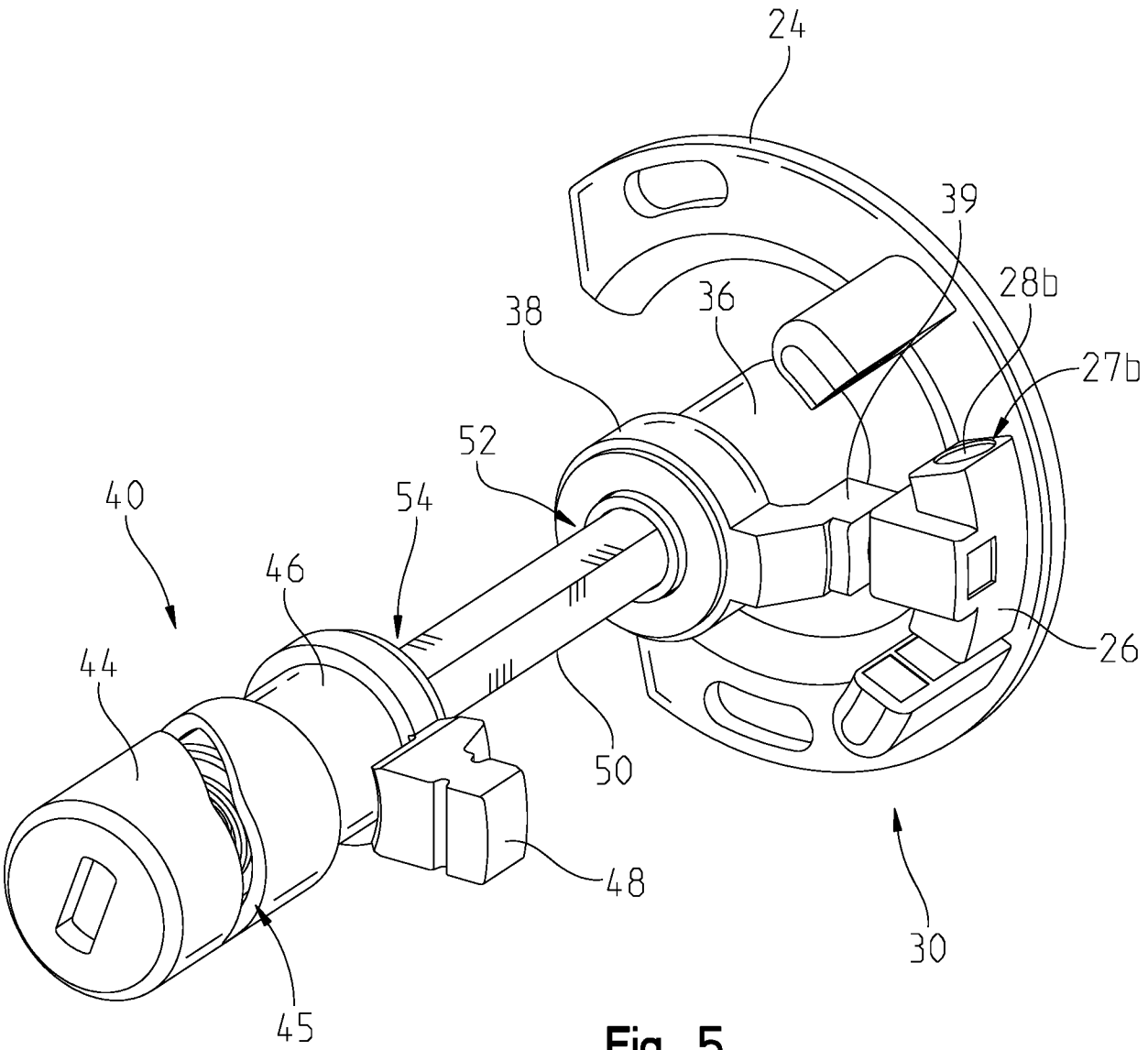
FIG. 5 is a perspective view of the locking lugs and shaft, where one of the locking lugs is coupled to the magnet holder operable to drive the cuff, the cuff including extension portions forming magnetic fields which interact with the magnet holder for driving the lock indicator assembly, according to the embodiment shown in FIG. 4.

Referring to FIG. 3, door lock 12 also includes shaft 50 extending between interior and exterior lock assemblies 30, 40. Shaft 50 operably couples interior and exterior lock assemblies 30, 40 such that when exterior lock assembly 40 is actuated (e.g., transitioned between the locked condition and the unlocked condition via a key), interior lock assembly 30 is also actuated. More specifically, and as can be seen in more detail in FIGS. 2, 4, and 5, shaft 50 extends between interior lug carrier 36 and exterior lug carrier 46. First end 52 of shaft 50 is coupled to interior lug carrier 36 and second end 54 of shaft 50 is coupled to exterior lug carrier 46. In some embodiments, shaft 50 is fixedly coupled to both interior lug carrier 36 and exterior lug carrier 46 such that shaft 50 transmits both linear and rotational movements between interior and exterior lug carriers 36, 46 (e.g., a keyed relationship of shaft 50 to each of interior lug carrier 36 and exterior lug carrier 46 such that interior and exterior lug carriers 36, 46 and shaft 50 rotate together). Optionally, in other embodiments, shaft 50 is rotatably coupled with interior lug carrier 36 (e.g., via a grooved coupling between shaft 50 and interior lug carrier 36). Exterior lug carrier 46 is rotationally fixed relative to exterior release cam 42. Pin 47 couples shaft 50 and exterior lug carrier 46. Exterior cam sleeve 44 receives a portion of exterior lug carrier 46 and includes channel 45 for receiving a portion of pin 47. Channel 45 provides a cam feature of exterior lock assembly 40. For example, channel 45 extends partially around a circumference of exterior cam sleeve 44 along a portion of the length of exterior cam sleeve 44. With pin 47 fixedly engaged with exterior lug carrier 46 and moveably positioned in channel 45 of exterior cam sleeve 44 and with exterior lug carrier 46 rotationally fixed relative to exterior release cam 42, rotation of exterior cam sleeve 44 about its longitudinal axis causes translation of pin 47 within channel 45. The rotational movement of exterior cam sleeve 44 is translated into linear movement of pin 47 and exterior lug carrier 46. Because interior and exterior lug carriers 36, 46 maintain a fixed linear distance between each other, when exterior lug carrier 46 moves in a linear direction, interior lug carrier 36 linearly translates in the same direction and the same distance.

As exterior lug carrier 46, and consequently exterior lug 48, moves between a first linear position and a second linear position, the lock status of exterior lock assembly 40 changes. Exterior lug carrier 46 and exterior lug 48 move linearly with respect to exterior hub 80. Hub 80 selectively restricts or allows rotational movement of exterior lug 48 relative to exterior hub 80, which correspond to locked and unlocked conditions, respectively. When exterior lug carrier 46 is positioned toward interior lock assembly 30 within exterior cam sleeve 44, exterior lock assembly 40 is in an unlocked state and allows rotational movement of exterior lug 48 and exterior release cam 42 relative to exterior hub 80. When exterior lug carrier 46 is positioned away from interior lock assembly 30 within exterior cam sleeve 44, exterior lock assembly 40 is in a locked state and exterior lug 48, and consequently exterior release cam 42, is restricted from rotational movement relative to exterior hub 80. The locked state is achieved by exterior lug carrier 46, exterior lug 48, and exterior release cam 42 being restricted in rotational movement, which blocks operator input motion (which seeks to rotate the associated release cam) from actuating latch bolt 18. For example, exterior lock assembly 40 includes exterior lug 48 which engages with adjacent structure of exterior hub 80 to restrict rotational movement of the aforementioned components. In one embodiment, lock channel engagement portion 49 of exterior lug 48 selectively engages exterior hub 80 when lock channel engagement portion 49 is positioned within lock channel 82 of exterior hub 80 (FIG. 7A).

Referring to FIG. 3, interior and exterior hubs 60, 80 are positioned opposite each other and are secured to door 10 (FIG. 1) and extend from interior and exterior sides of door 10, respectively. Interior and exterior hubs 60, 80 are, in use, both rotationally and translationally fixed relative to door 10 and longitudinal axis 75.

Referring to FIG. 7A exterior hub 80 includes lock channel 82 and unlock channel 84. Lock channel 82 is formed by walls that define a longitudinal slot. Unlock channel 84 is formed within exterior hub 80 and defines an arcuate groove. When lock channel engagement portion 49 of exterior lug 48 is positioned in lock channel 82, exterior lug 48 is restricted from rotational movement relative to exterior cam sleeve 44, which blocks an operator input motion from actuating egress handle 14 (FIG. 1) to move latch bolt 18 (FIG. 1) from an engaged position to a disengaged position. When lock channel engagement portion 49 of exterior lug 48 is positioned in unlock channel 84 (e.g., lock engagement portion 49 is transitioned from lock channel 82 to unlock channel 84 by rotating exterior cam sleeve 44, resulting in translating exterior lug 48 along longitudinal axis 75), exterior lug 48 is free to rotate within the arcuate groove of unlock channel 84, and consequently exterior release cam 42 is free to rotate, allowing a user input to actuate ingress handle 16 and latch bolt 18.

Turning to a discussion of interior hub 60, in some embodiments, interior hub 60 is shaped such that lock indicator engagement portion 39 of interior lug 38 is able to freely move within interior space 67 (FIG. 8B) of interior hub 60, whether exterior lock assembly 40 is in a locked or unlocked condition. In other embodiments, interior hub 60 optionally includes similar features as exterior hub 80. For example, interior hub 60 may include a lock channel and an unlock channel defined in interior walls 63 of hub body. The lock channel may be formed by walls that define a longitudinal slot. The unlock channel may be formed within interior hub 60 and may define an arcuate groove.

Figure 10:
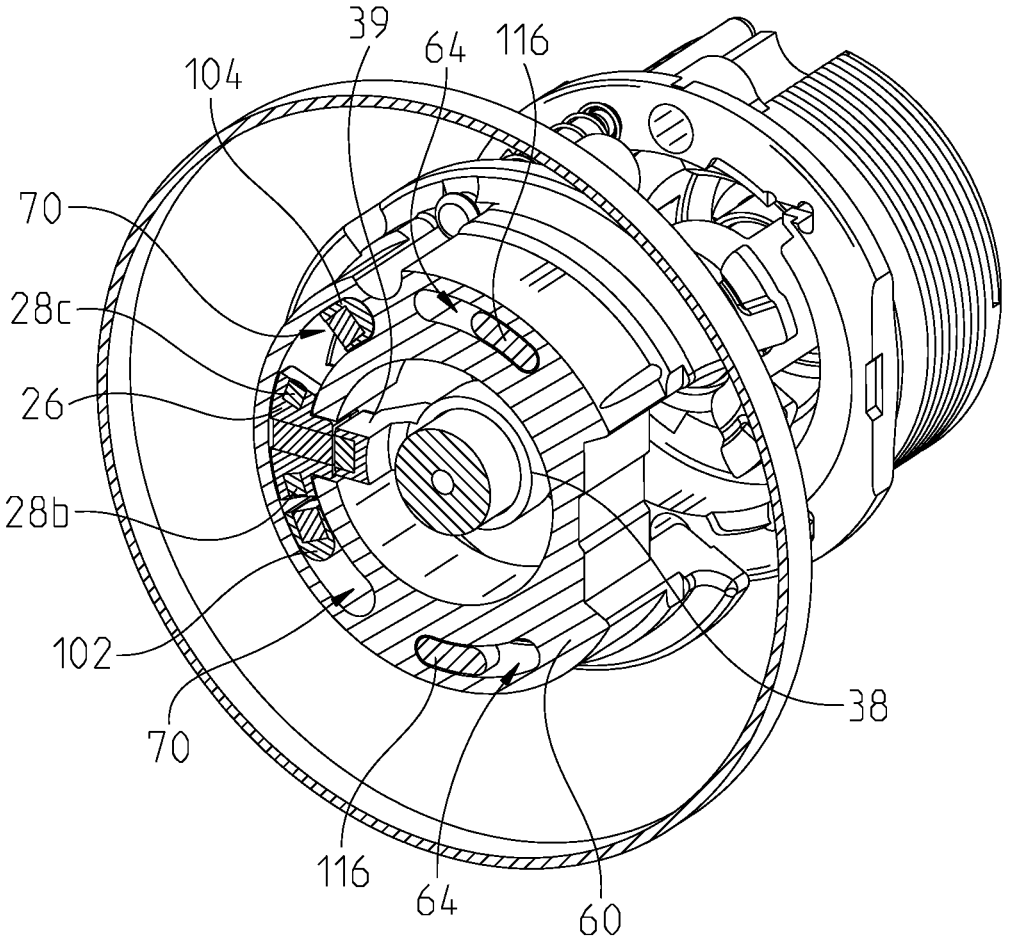
FIG. 10 is a sectional view of components of a lock indicator assembly positioned with an interior lock assembly, according to one embodiment.

Referring to FIG. 7B, interior hub 60 further includes features that cooperate with lock indicator assembly 20. For example, interior hub 60 includes magnet holder channel 66 defined through interior wall 63 of interior hub 60. Magnet holder channel 66 is formed extending longitudinally along a portion of the body of interior hub 60. Magnet holder channel 66 receives magnet holder 26 of lock indicator assembly 20. Magnet holder channel 66 matches the exterior profile of magnet holder 26 to block rotational movement or any movement other than movement along longitudinal axis 75 substantially parallel to shaft 50, such that magnet holder 26 transitions linearly from a first position to a second position within magnet holder channel 66. In some embodiments, magnet holder channel 66 includes portions that do not extend all the way through interior wall 63 of interior hub 60. For example, magnet holder channel 66 includes lateral portions that are defined in the body of interior hub 60 (e.g., defined between interior and exterior walls 63, 65). FIG. 10 illustrates magnet holder 26 positioned within magnet holder channel 66 (not labelled because magnet holder 26 fills magnet holder channel 66 in FIG. 10), wherein the lateral portions of magnet holder channel 66 are intersecting and are coextensive with cuff channel 70, which is described hereafter. Optionally, magnet holder channel 66 and cuff channel 70 may be separate such that they are not intersecting, nor coextensive.

Interior hub 60 further includes cuff channel 70 positioned at one of the longitudinal ends of interior hub 60. Cuff channel 70 receives a portion of a cuff as will be described hereafter. Cuff channel 70 is positioned coaxially with shaft 50 and formed to allow cuff 24 to travel a predefined distance within cuff channel 70. Cuff channel 70 includes an arcuate groove defined within the body of interior hub 60. In some embodiments, cuff channel 70 includes first cuff channel 70*a* and second cuff channel 70*b* positioned such that first and second cuff channels 70*a*, 70*b* are positioned on each side of magnet holder channel 66. For example, first cuff channel 70*a* is positioned proximate a first side of magnet holder channel 66 and second cuff channel 70*b* is positioned proximate a second side of magnet holder channel 66.

Turning now to a discussion of lock indicator assembly 20, lock indicator assembly 20 is mechanically actuated by components of interior and/or exterior lock assemblies 30, 40. More specifically, lock indicator assembly 20 is driven by mechanical input received from the components of interior and exterior assemblies 30, 40 resulting in the lock and unlock conditions of door lock 12.

As shown in FIGS. 2 and 4-6, lock indicator assembly 20 includes flag 22, cuff 24, magnet holder 26, and rose 29*a*. Magnet holder 26 includes receivers 27 for receiving at least one permanent magnet 28. Coupling permanent magnet 28*a* forms a coupling magnetic field operable to interact with lock indicator engagement portion 39 of interior lug 38 of interior lock assembly 30 and at least one lock indicator magnet 28*b* forms a lock indicator magnetic field that is operable to interact with magnet fields associated with cuff 24. Permanent magnets 28 may be integrated directly into magnet holder 26. In one example, magnet holder 26 includes a first receiver 27*a* for receiving the coupling permanent magnet 28*a*, second receiver 27*b* for receiving first lock indicator magnet 28*b*, and third receiver 27*c* for receiving second lock indicator magnet 28*c*. The coupling permanent magnet 28*a* is disposed such that it primarily interacts with lock indicator engagement portion 39 of interior lock assembly 30. First and second lock indicator magnets 28*b*, 28*c* are disposed such that they primarily interact with cuff 24. Longitudinal axes of first and second lock indicator magnets 28*b*, 28*c* are disposed substantially along an arcuate path that matches an arcuate path defined by cuff channel 70 of interior hub 60 such that the magnetic fields defined by first and second lock indicator magnets 28*b*, 28*c* are at least partially disposed within the arcuate path. In some embodiments, a longitudinal axis of coupling permanent magnet 28*a* is positioned at a substantially or a slightly less than 90-degree angle relative to the longitudinal axes of first and second lock indicator magnets 28*b*, 28*c*, such that the coupling permanent magnet 28*a* is oriented radially relative to the arcuate path.

Figure 6:
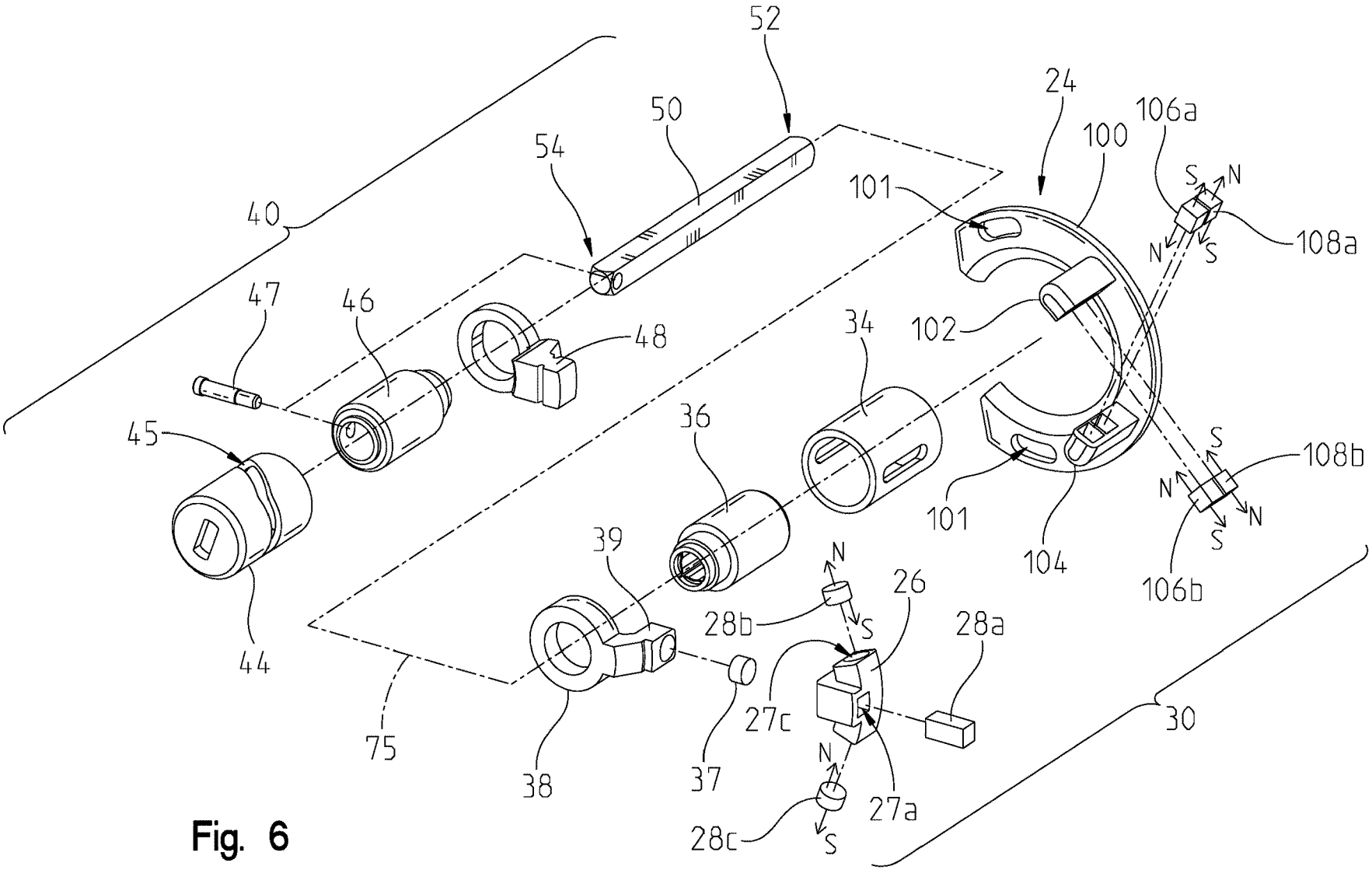
FIG. 6 is an exploded view of the embodiment shown in FIGS. 4 and 5, where the polarity of the permanent magnets is shown, the permanent magnets operable to drive the lock indicator assembly.

As previously discussed with respect to FIG. 6 and as shown in FIGS. 8A-9B and 10, magnet holder 26 is positioned at least partially within magnet holder channel 66 of interior hub 60 and transitions between a first position and a second position within magnet holder channel 66. Magnet holder channel 66 and cuff channel 70 (as shown in FIGS. 7B and 10) are partially coextensive such that magnet holder 26 is partially positioned within cuff channel 70 (e.g., second and third magnet receivers 27*b*, 27*c* and their corresponding permanent magnets 28*b*, 28*c*). When cuff 24 is positioned with interior hub 60 such that first and second extension portions 102, 104 are positioned in cuff channel 70 of interior hub 60, first and second magnetic fields (discussed hereafter) are at least partially within cuff channel 70.

Referring to FIG. 6, cuff 24 includes cap 100 which is positioned coaxially relative to interior hub 60. In some embodiments, cap 100 is arcuately shaped (e.g., partial or full circular or ring-shaped), but may include other shapes. Cuff 24 includes first extension portion 102 and second extension portion 104 that extend from arcuate cap 100. First and second extension portions 102, 104 are configured to be received into cuff channel 70 of interior hub 60 (FIG. 7B). Cuff channel 70 of interior hub 60 includes an arc length longer than an arc length defined between first and second extension portions 102, 104 along substantially the same radius of curvature, allowing cuff 24 to rotate about longitudinal axis 75 and transition between various positions relative to interior hub 60. A spring positioned between rose 29*a* and cap 100 of cuff 24 to maintain the position of cuff 24 relative to hub 60 along hub longitudinal axis 75.

Permanent magnets 106, 108 of first and second extension portions 102, 104 form a first magnetic field disposed at a first longitudinal position and a second magnetic field at a second longitudinal position. The first magnetic field is significantly generated by permanent magnets positioned with first and second extension portions 102, 104 at a first longitudinal position. For example, first permanent magnet 106*a* and second permanent magnet 106*b* generate the first magnetic field at the first longitudinal position. First and second permanent magnets 106*a*, 106*b* each have north and south poles, wherein the like poles are oriented toward each other along the arcuate path. The second magnetic field is generated by permanent magnets positioned with first and second extension portions 102, 104 at a second longitudinal position. For example, third permanent magnet 108*a* and fourth permanent magnet 108*b* form the second magnetic field at the second longitudinal position. Third and fourth permanent magnets 108*a*, 108*b* each have north and south poles, with the like poles oriented toward each other along the arcuate path such that the poles that are oriented toward each other are different from the poles of first and second permanent magnets 106 of the first magnetic field. The first and second magnetic fields are described in more detail below with relation to magnet holder 26 and interior hub 60.

Figure 8A:
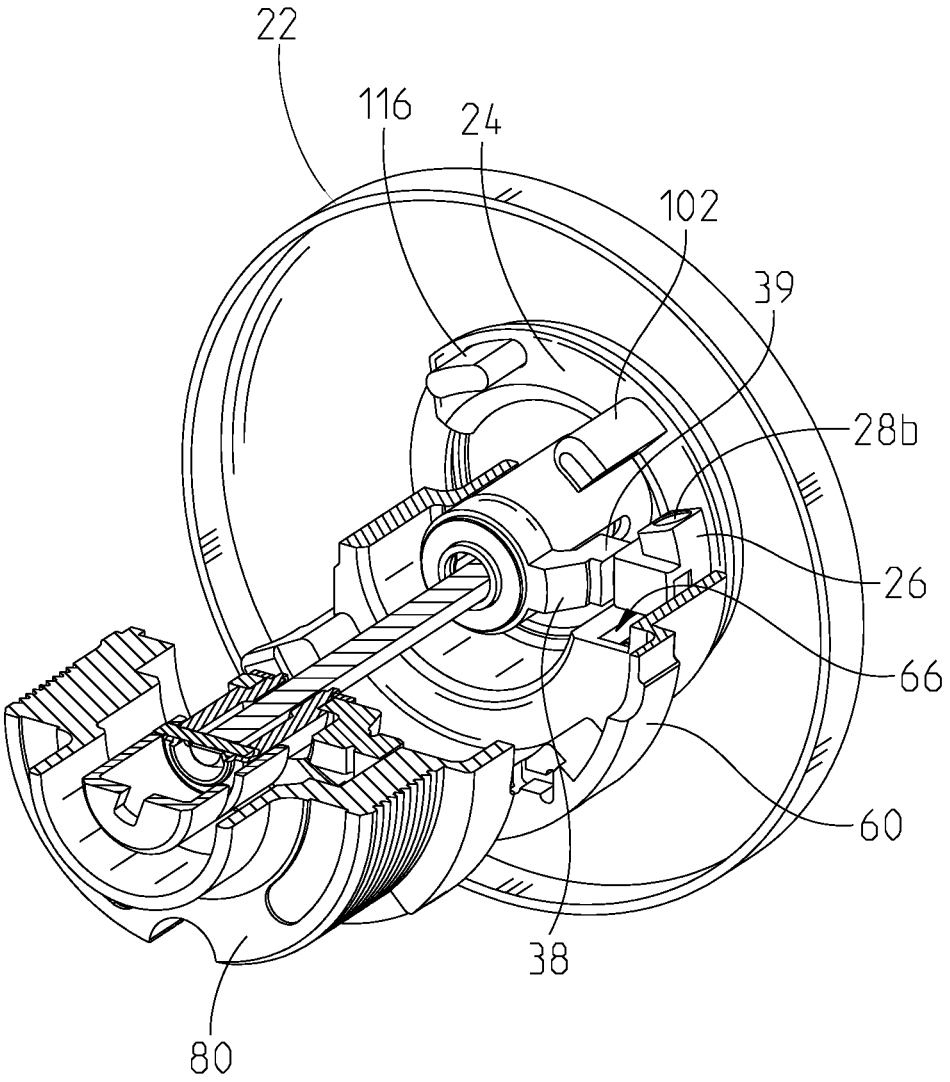
FIG. 8A is a partial sectional view of an interior and exterior hub with interior and exterior locking lugs positioned within respective hubs and operably coupled via a shaft, the interior hub and interior locking lug operably coupled to a magnetically driven lock indicator assembly, where the exterior door lock is in an unlocked condition and the lock indicator assembly is positioned to display an unlocked status associated with the locked condition, according to one embodiment.
Figure 8B:
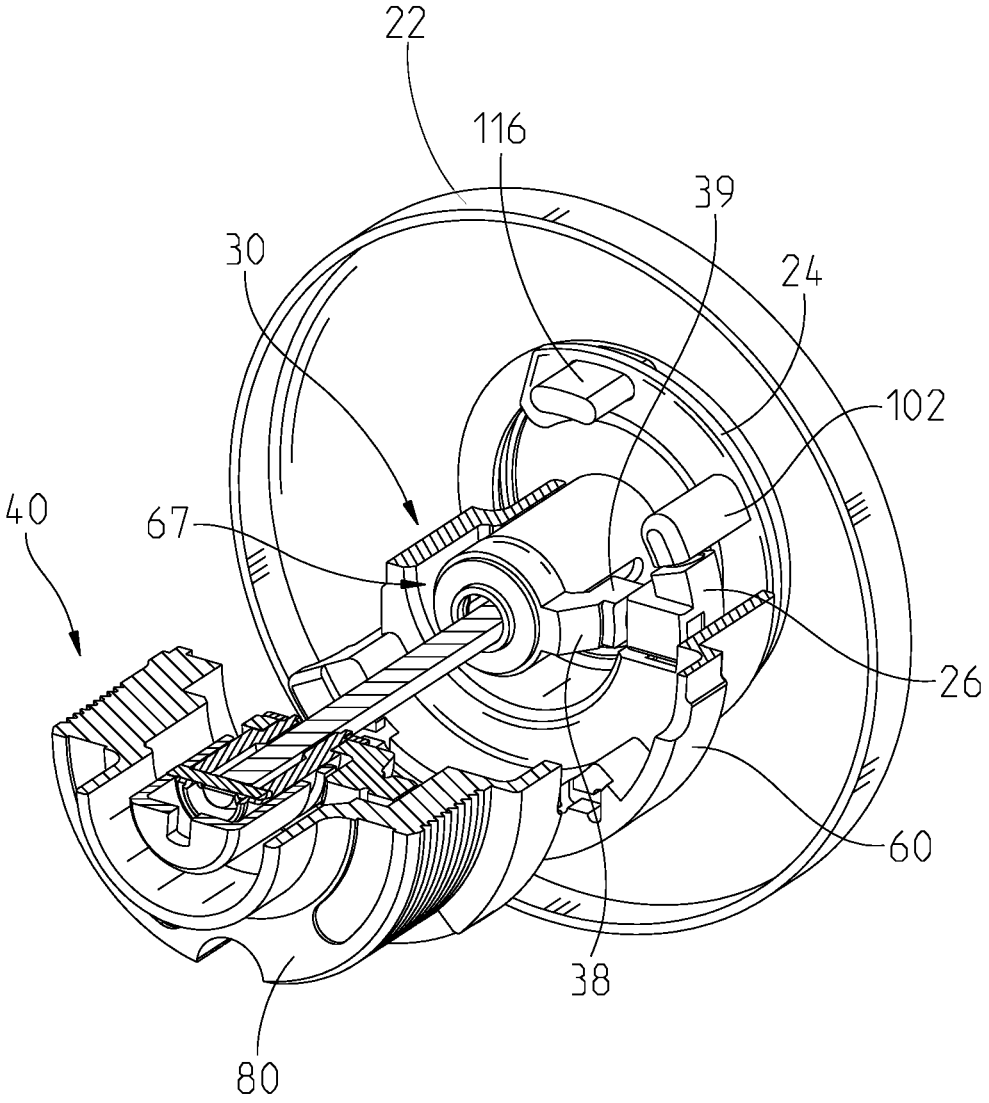
FIG. 8B is a partial sectional view of the embodiment of FIG. 8A, where the exterior door lock is in a locked condition and the lock indicator assembly is positioned to display a locked status associated with the locked condition, according to one embodiment.

Referring to FIGS. 6, 8A, and 8B, in one example, first and second permanent magnets 106*a*, 106*b* of cuff 24 generate an operative first magnetic field when the south poles of first and second permanent magnets 106*a*, 106*b* of cuff 24 face substantially toward each other in cuff channel 70. Third and fourth permanent magnets 108*a*, 108*b* of cuff 24 generate a second operative magnetic field when the north poles of third and fourth permanent magnets 108 of cuff 24 face substantially toward each other in cuff channel 70. The first and second operative magnetic fields are longitudinally spaced from each other and form opposite magnetic fields. Magnet holder 26 includes second and third lock indicator magnets 28*b*, 28*c* that form the lock indicator magnetic field where the second and third lock indicator magnets 28*b*, 28*c* are oriented such that the north and south poles are generally oriented in the same direction, essentially forming the lock indicator magnetic field with a unitary north pole and a unitary south pole substantially tangential to the arcuate path. When magnet holder 26 is in the first position (shown in FIG. 8A), second and third lock indicator magnets 28*b*, 28*c* interact with the first operative magnetic field generated by first and second permanent magnets 106*a*, 106*b*. Because the north poles of the first permanent magnets 106 are oriented inward, the unitary south pole of the lock indicator magnetic field of magnet holder 26 is attracted to the north pole of one of first and second permanent magnets 106*a*, 106*b* on the one end of the lock indicator magnetic field and is repelled by the north pole of the other of first and second permanent magnets 106*a*, 106*b* on the other end of the lock indicator magnetic field. Because cuff 24 rotates relative to interior hub 60, the attractive and repulsive forces of the magnet holder magnetic field and the first magnetic field of cuff 24 cause cuff 24 to rotate in a first direction. When magnet holder 26 is transitioned from the first position to the second position (shown in FIG. 8B), cuff 24 rotates in the opposite, second direction as the magnet holder magnetic field of magnet holder 26 interacts with the second operative magnetic field generated by the south poles of third and fourth permanent magnets 108*a*, 108*b* that are oriented inward. Similar effects may be achieved by altering the directions of the poles in a number of ways. Generally, magnet holder 26 interacts with cuff 24 such that when magnet holder 26 is in a first longitudinal position, cuff 24 rotates within the channel in a first direction and when magnet holder 26 is in a second longitudinal position, cuff 24 rotates within the channel in a second direction. A spring clip or radial detent associated with hub 60 may be utilized to hold the axial position of cuff 24 relative to hub 60, i.e., may restrict cuff 24 from axial displacement relative to hub 60 along hub longitudinal axis 75. The magnetic attraction between cuff 24 and magnet holder 26 may also hold the axial position of cuff 24 relative to hub 60.

Interior hub 60, cuff 24, and magnet holder 26 may all be designed such that second and third lock indicator magnets 28*b*, 28*c* never contact first, second, third, or fourth permanent magnets 106*a*, 106*b*, 108*a*, 108*b* of cuff 24. For example, interior hub 60 includes stop channels 64 (FIG. 7B) that receive retainers 116 extending from lock indicator assembly 20 (e.g., extending from the flag 22 as shown in FIGS. 8A and 8B, or optionally from cuff 24). Stop channels 64 are dimensioned such that retainers 116 transition between a first position and a second position associated with displaying a lock status and an unlock status (see FIG. 10) and limit rotation of flag 22 and cuff 24 (e.g., flag 22 and cuff 24 are rotationally constrained relative to each other) beyond the first and second position. The first and second positions defined by stop channels 64 and retainers 116 allow cuff 24 to be positioned such that first and second extension portions 102, 104 and more specifically first, second, third, and fourth permanent magnets 106*a*, 106*b*, 108*a*, 108*b* are limited from contacting second and third magnets 28*b*, 28*c* of the magnet holder. For example, first, second, third, and fourth permanent magnets 106*a*, 106*b*, 108*a*, 108*b* are spaced from second and third magnets 28*b*, 28*c* when cuff 24 is in the first or second position associated with the lock status and the unlock status. Including an arcuate spacing of the magnets of cuff 24 and magnet holder 26 allows magnet holder 26 to transition between the first position and the second position more easily without becoming detached from lock indicator engagement portion 39 of interior lug 38 of interior lock assembly 30. When egress handle 14 is actuated, interior lug 38 is thereby rotated such that magnet holder 26 and lock indicator engagement portion 39 of interior lug 38 of interior lock assembly 30 magnetically decouple from each other. When egress handle 14 returns to a neutral position, magnet holder 26 and lock indicator engagement portion 39 of interior lug 38 of interior lock assembly 30 are able to magnetically recouple when interior lug 38 is returned to the neutral position (e.g., via a bias to the neutral position). As magnet holder 26 magnetically couples and decouples to and from interior lug 38, the lock status displayed by lock indicator assembly 30 remains unchanged, as magnet holder 26 maintains its unlocked position.

Figure 9A:
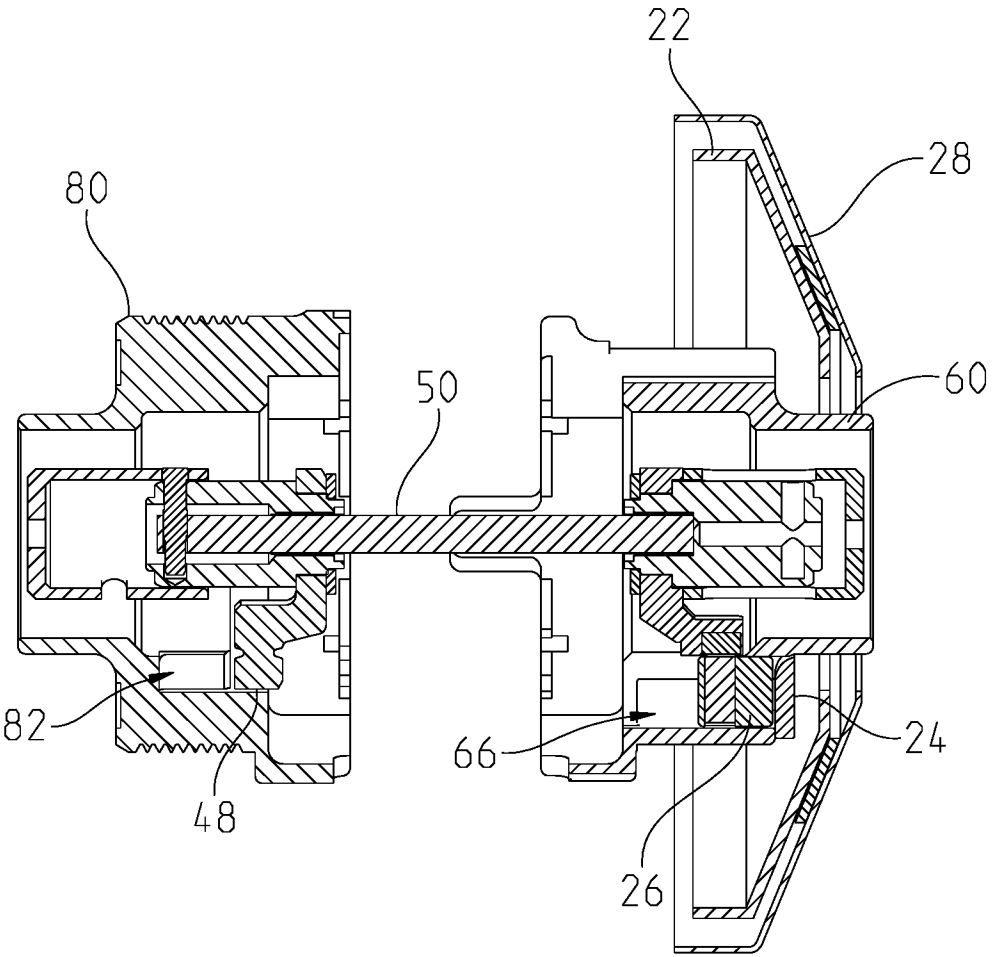
FIG. 9A is a sectional side view of interior and exterior lock assemblies coupled to a lock indicator assembly, where the exterior lock assembly is positioned in an unlocked condition and the lock indicator assembly is positioned to display an unlocked status, according to one embodiment.
Figure 9B:
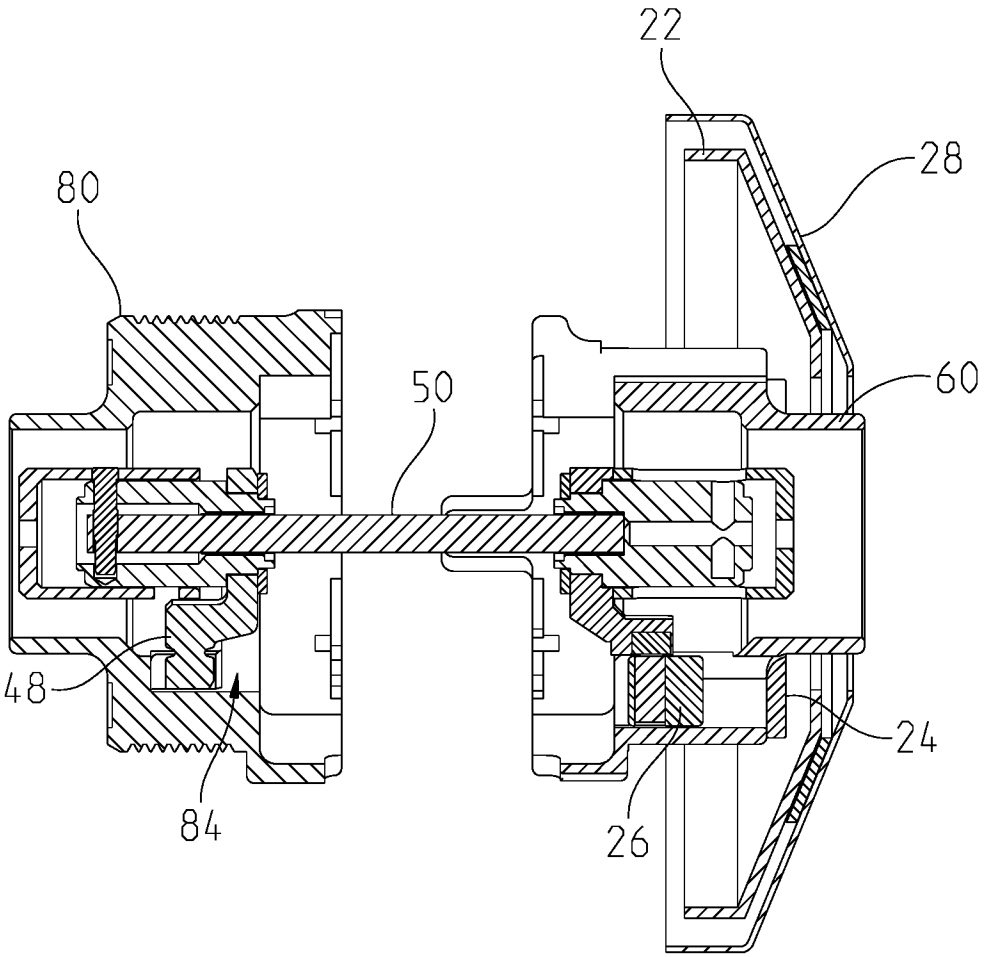
FIG. 9B is a sectional side view of the embodiment of FIG. 9A, where the exterior lock assembly is positioned in a locked condition and the lock indicator assembly is positioned to display a locked status, according to one embodiment.

Lock indicator assembly 20 includes flag 22 and rose 29*a*. Flag 22 is operably coupled to cuff 24 such that when cuff 24 rotates, flag 22 likewise rotates. For example, flag 22 includes retainers 116 (FIG. 3) extending therefrom. Cuff 24 includes receivers 101 (e.g., apertures) for receiving retainers 116. When receivers 101 and retainers 116 are engaged, cuff 24 and flag 22 are rotationally coupled such that when one rotates, the other also rotates. Rose 29*a* includes windows 110 through which lock and unlock indicators 112, 114 (FIG. 2) of flag 22 are alternately visible. Windows 110 of rose 29*a* are dimensioned to display only one of lock and unlock indicators 112, 114 of flag 22 in a given moment. For example, lock indicator 112 is visible when cuff 24 is in a first rest position and unlock indicator 114 is visible when cuff 24 is in a second rest position. The first rest position is associated with the position of cuff 24 when locking lug 49 is positioned in lock channel 82 of exterior hub 80 (FIGS. 8B and 9B), and the second rest position is associated with the position of cuff 24 when locking lug 49 is positioned in unlock channel 84 of exterior hub 80 (FIGS. 8A and 9A). In embodiments having a plurality of windows 110, a plurality of lock indicators 112 and unlock indicators 114 are included on flag 22 such that the same status indicator (i.e., locked or unlocked) are displayed through windows 110 at each rest position of indicator assembly 20. Lock indicator 112 may be a graphical indicator and/or a color indicator. Similarly, unlock indicator 114 may be a graphical indicator and/or a color indicator. For example, unlock indicator 114 may be a green portion of each flag 22, while lock indicator 112 may be a red portion of each flag 22.

A description of the function of door lock 12 will now be provided to facilitate understanding of how door lock 12 works with respect to the components previously disclosed. When door lock 12 is installed on door 10, door lock 12 can be transitioned between a locked condition and an unlocked condition, where lock indicator assembly 20 displays the lock status of door lock 12. Door lock 12 can be transitioned between the locked condition and the unlocked condition by transitioning exterior lug 48 of exterior lock assembly 40 into lock channel 82 of exterior hub 80 (e.g., via actuation of a lock input). As exterior lug 48 is transitioned into lock channel 82, exterior lug 48 is unable to rotate along longitudinal axis 75. As exterior lug 48 transitions longitudinally along or parallel to longitudinal axis 75, interior lug 38 likewise transitions along or parallel to longitudinal axis 75.

Interior lug 38 includes lock indicator engagement portion 39 which is magnetically coupled to magnet holder 26. Because interior lug 38 travels between a first position and a second position as exterior lug 48 transitions between the locked position and the unlocked position, and because interior lug 38 is magnetically coupled to magnet holder 26, magnet holder 26 likewise transitions between a first and second position (e.g., within magnet holder channel 66 of the interior hub 60). Magnet holder 26 includes permanent magnets 28*b*, 28*c* that create the magnet holder magnetic field. The magnet holder magnetic field interacts with the first and second magnetic fields generated by first, second, third, or fourth permanent magnets 106*a*, 106*b*, 108*a*, 108*b* of cuff 24. When magnet holder 26 is in the first position, the magnet holder magnetic field interacts with the first operative magnetic field of cuff 24. The interaction results in an attractive force between permanent magnets 28*b*, 28*c* of magnet holder 26 and of second permanent magnet 106*b* on first extension portion 102 of cuff 24 at a first longitudinal position on cuff 24, and a repulsive force between permanent magnets 28*b*, 28*c* of the magnet holder 26 and first permanent magnet 106*a* on the second extension portion 104 of cuff 24 at the first longitudinal position. Because cuff 24 is positioned relative to interior hub 60 in a rotational engagement, first and second extension portions 102, 104 of cuff 24 rotate to a first predetermined position (i.e., the first rest position) within cuff channel 70 of interior hub 60. When magnet holder 26 is in the second position, the magnet holder magnetic field interacts with second operative magnetic field of cuff 24. The interaction results in a repulsive force between permanent magnets 28*b*, 28*c* of magnet holder 26 and the third permanent magnet 108*a* on the first extension portion 102 of cuff 24 at second longitudinal position on the cuff 24, and an attractive force between permanent magnets 28*b*, 28*c* of magnet holder 26 and fourth permanent magnet 108*b* of second extension portion 104 of cuff 24 at the second longitudinal position. This results in cuff 24 rotating to a second predetermined position (i.e., the second rest position) within cuff channel 70 of interior hub 60. Interior lug 38 can be disengaged from magnet holder 26 when egress handle 14 is actuated such that interior lug 38 is rotated within interior space 67 of interior hub 60 because magnet holder 26 is constrained to a specific circumferential position within magnet holder channel 66 of interior hub 60. As interior lug 38 is returned to the neutral position, interior lug 38 and magnet holder 26 re-engage in a magnetic coupling.

Flag 22 is coupled to cuff 24 such that as cuff 24 rotates, flag 22 also rotates. Flag 22 includes indicators (e.g., lock indicator 112 and unlock indicator 114) that are visible through window 110 of rose 29*a* to indicate the specific lock status of exterior lug 48 (e.g., a lock and unlock symbol, a green and red-colored portion). Flag 22 and rose 29*a* are configured to include two positions on opposite sides at which the lock status is indicated (e.g., the top and bottom when installed). This simplifies installation such that flag 22 and rose 29*a* can be aligned more simply and the lock status is visible from multiple angles.

The magnetic-driven lock indicator provides various benefits, including, but not limited to, reduced wear of the internal components of the lock system to reduce wear of the components critical to maintain the locking function of door lock 12, lock status updates directly tied to the component that provides the mechanical interference for preventing actuation of the ingress handle (e.g., exterior lug 48), and a status indicator that provides a quick transition between displaying the lock status and the unlock status due to the opposite magnetic fields.

Additional description of a lock status indicator such as the one described above can be found in U.S. Provisional Patent Application Ser. No. 63/033,806 filed Jun. 2, 2020 and the U.S. utility application assigned, entitled LOCK STATUS INDICATOR and filed on even date herewith, the entire disclosures of which are hereby incorporated by reference in their entireties.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A cylindrical lock having a first side and a second side, the lock comprising:

a latch bolt moveable between an engaged position operable to limit ingress and egress and a disengaged position operable to permit ingress and egress;

a first actuator operable to receive a first operator input motion to actuate the first actuator to move the latch bolt from the engaged position to the disengaged position, the first actuator being on the first side of the cylindrical lock;

a second actuator operable to receive a second operator input motion to actuate the second actuator to move the latch bolt from the engaged position to the disengaged position, the second actuator being positioned on the second side of the cylindrical lock;

a first locking lug actuatable between a locked position and an unlocked position, the locked position of the first locking lug corresponding to the cylindrical lock in a locked condition blocking the first operator input motion from actuating the first actuator to move the latch bolt from the engaged position to the disengaged position;

a magnet holder having at least one permanent magnet, the magnet holder selectively operably coupled to the first locking lug such that the magnet holder moves with the first locking lug between the locked position and the unlocked position when the magnet holder and the first locking lug are operably coupled; and a flag having a lock signal signaling the locked position of the first locking lug and an unlock signal signaling the unlocked position of the first locking lug, the flag selectively displaying only one of the lock signal and the unlock signal, the flag being magnetically-driven by the at least one permanent magnet of the magnet holder between a lock signal position displaying the lock signal and an unlock signal position displaying the unlock signal;

wherein the first locking lug undergoes a movement with the first operator input motion when the first locking lug is in the unlocked position, the movement of the first locking lug decoupling the first locking lug and the magnet holder.

2. The cylindrical lock of claim 1, further comprising:

a first hub on the first side of the cylindrical lock and a second hub on the second side of the cylindrical lock, wherein in the locked position of the first locking lug, the first hub blocks a movement of the first locking lug and thereby blocks the first operator input motion from actuating the first actuator to move the latch bolt from the engaged position to the disengaged position; and a second locking lug operably coupled to the first locking lug and operable to transition between a first position associated with the engaged position of the first locking lug and a second position associated with the disengaged position.

3. The cylindrical lock of claim 2, wherein the at least one permanent magnet of the magnet holder includes a coupling permanent magnet operable to selectively couple with the second locking lug, and thereby with the first locking lug, and transition with the second locking lug between the first position and the second position.

4. The cylindrical lock of claim 3, further comprising a cuff positioned coaxially with the second hub, the cuff operable to transition between a locked status position and an unlocked status position.

5. The cylindrical lock of claim 4, wherein the cuff includes a first extension portion and a second extension portion, the first extension portion and the second extension portion including a plurality of permanent magnets forming a first magnetic field and a second magnetic field, wherein when the magnet holder is in the first position the magnet holder interacts with the first magnetic field driving the cuff to the locked status position and when the magnet holder is in the second position the magnet holder interacts with the second magnetic field resulting in driving the cuff to the unlocked status position.

6. The cylindrical lock of claim 5, wherein the flag is operably coupled to the cuff and operable to move with the cuff between the locked status position corresponding to the lock signal position of the flag, and the unlocked status position corresponding to the unlock signal position of the flag.

7. A lock indicator assembly for a cylindrical lock having a first side and a second side, the lock indicator assembly comprising:

a first locking lug positioned on the first side of the cylindrical lock and actuatable between a locked position and an unlocked position, the locked position of the locking lug positioning the cylindrical lock in a locked condition;

a shaft extending from the first side of the cylindrical lock to the second side of the cylindrical lock and actuatable between a first shaft position associated with the locked position of the first locking lug and a second shaft position associated with the unlocked position of the first locking lug;

a second locking lug positioned on the second side of the cylindrical lock and operably coupled to the first locking lug via the shaft and actuatable between a corresponding locked position associated with the locked position of the first locking lug and a corresponding unlocked position associated with the unlocked position of the first locking lug;

a cuff positioned on the second side of the cylindrical lock, the cuff actuatable between a locked status position associated with the locked position of the first locking lug, the first shaft position, and the corresponding locked position of the second locking lug, and an unlocked status position associated with the unlocked position of the first locking lug, the second shaft position, and the corresponding unlocked position of the second locking lug;

a flag operably coupled to the cuff such that the flag moves with the cuff, the flag operable to display a locked status when the cuff is in the locked status position and an unlocked status when the cuff is in the unlocked status position; and a magnet holder with at least one magnet holder permanent magnet, the magnet holder positioned on the second side of the cylindrical lock and operably and selectively coupled with the second locking lug and operable to transition between a first magnet holder position associated with the locked position of the first locking lug and a second magnet holder position associated with the unlocked position of the first locking lug, the at least one magnet holder permanent magnet operable to magnetically drive the cuff between the locked status position and the unlocked status position.

8. The lock indicator assembly for a cylindrical lock of claim 7, further comprising:

a first hub positioned on the first side of the cylindrical lock, the first hub having a lock channel, said first locking lug occupying said lock channel in the locked position, the lock channel blocking a movement of the first locking lug needed to actuate the cylindrical lock; and a second hub positioned on the second side of the cylindrical lock, the second locking hub having an interior space, the second locking lug moving between the corresponding locked position and the corresponding unlocked position within the interior space of the second hub.

9. The lock indicator assembly for a cylindrical lock of claim 7, wherein the cuff includes a first extension portion and a second extension portion, the first extension portion and the second extension portion including a plurality of cuff permanent magnets forming a first magnetic field and a second magnetic field, the magnet holder magnetically engaging the first magnetic field of the cuff in the first magnet holder position to position the cuff in the locked status position, the magnet holder magnetically engaging the second magnetic field of the cuff in the second magnet holder position to position the cuff in the unlocked status position.

10. The lock indicator assembly for a cylindrical lock of claim 9, wherein the first extension portion of the cuff is circumferentially spaced from the second extension portion of the cuff.

11. The lock indicator assembly for a cylindrical lock of claim 10, wherein the cuff and the flag are operable to rotate between the locked status position and the unlocked status position.

12. The lock indicator assembly for a cylindrical lock of claim 9, wherein the plurality of cuff permanent magnets includes a first cuff permanent magnet positioned with the first extension portion at a first longitudinal position relative to the cuff and a second cuff permanent magnet positioned with the second extension portion at the first longitudinal position relative to the cuff, the first and second cuff permanent magnets forming the first magnetic field, and wherein the plurality of permanent magnets includes a third cuff permanent magnet positioned with the first extension portion at a second longitudinal position relative to the cuff and a fourth cuff permanent magnet positioned with the second extension portion at the second longitudinal position relative to the cuff, the third and fourth permanent magnets forming the second magnetic field.

13. The lock indicator assembly for a cylindrical lock of claim 12, wherein the first and second cuff permanent magnets are oriented such that north poles are substantially facing toward each other, and wherein the third and fourth cuff permanent magnets are oriented such that south poles are substantially facing toward each other.

14. The lock indicator assembly for a cylindrical lock of claim 13, wherein the at least one magnet holder permanent magnet comprises at least two magnet holder permanent magnets operable to selectively magnetically interact with the first and second magnetic fields formed by the plurality of cuff permanent magnets, the at least two magnet holder permanent magnets each having opposite poles oriented in substantially the same direction.

15. A cylindrical lock having a first side and a second side, the lock comprising:

a latch bolt moveable between an engaged position operable to limit ingress and egress and a disengaged position operable to permit ingress and egress;

a first actuator operable to receive a first operator input motion to actuate the first actuator to move the latch bolt from the engaged position to the disengaged position, the first actuator being on the first side of the cylindrical lock;

a second actuator operable to receive a second operator input motion to actuate the second actuator to move the latch bolt from the engaged position to the disengaged position, the second actuator being positioned on the second side of the cylindrical lock;

a first locking lug actuatable between a locked position and an unlocked position, the locked position of the first locking lug corresponding to the cylindrical lock in a locked condition blocking the first operator input motion from actuating the first actuator to move the latch bolt from the engaged position to the disengaged position;

a magnet holder having at least one permanent magnet, the magnet holder selectively operably coupled to the first locking lug such that the magnet holder moves with the first locking lug between the locked position and the unlocked position when the magnet holder and the first locking lug are operably coupled;

a flag having a lock signal signaling the locked position of the first locking lug and an unlock signal signaling the unlocked position of the first locking lug, the flag selectively displaying only one of the lock signal and the unlock signal, the flag being magnetically-driven by the at least one permanent magnet of the magnet holder between a lock signal position displaying the lock signal and an unlock signal position displaying the unlock signal;

a first hub on the first side of the cylindrical lock and a second hub on the second side of the cylindrical lock, wherein in the locked position of the first locking lug, the first hub blocks a movement of the first locking lug and thereby blocks the first operator input motion from actuating the first actuator to move the latch bolt from the engaged position to the disengaged position;

a second locking lug operably coupled to the first locking lug and operable to transition between a first position associated with the engaged position of the first locking lug and a second position associated with the disengaged position; and a cuff positioned coaxially with the second hub, the cuff operable to transition between a locked status position and an unlocked status position, wherein the cuff includes a first extension portion and a second extension portion, the first extension portion and the second extension portion including a plurality of permanent magnets forming a first magnetic field and a second magnetic field, wherein when the magnet holder is in the first position the magnet holder interacts with the first magnetic field driving the cuff to the locked status position and when the magnet holder is in the second position the magnet holder interacts with the second magnetic field resulting in driving the cuff to the unlocked status position;

wherein the at least one permanent magnet of the magnet holder includes a coupling permanent magnet operable to selectively couple with the second locking lug, and thereby with the first locking lug, and transition with the second locking lug between the first position and the second position.

16. The cylindrical lock of claim 15, wherein the flag is operably coupled to the cuff and operable to move with the cuff between the locked status position corresponding to the lock signal position of the flag, and the unlocked status position corresponding to the unlock signal position of the flag.

* * * * *